United States Patent [19]

Chiesa, Jr.

[11] 4,038,195

[45] July 26, 1977

[54] FIRE FIGHTING COMPOSITIONS

[75] Inventor: Peter Jordan Chiesa, Jr., Coatesville, Pa.

[73] Assignee: Philadelphia Suburban Corporation, Bryn Mawr, Pa.

[21] Appl. No.: 525,175

[22] Filed: Nov. 19, 1974

Related U.S. Application Data

[63] Continuation-in-part of Ser. No. 254,404, May 18, 1972, Pat. No. 3,849,315, Ser. No. 307,479, Nov. 17, 1972, abandoned, Ser. No. 369,584, June 13, 1973, Pat. No. 3,957,657, and Ser. No. 434,544, Jan. 18, 1974, abandoned, said Ser. No. 254,404, Ser. No. 307,479, and Ser. No. 369,584, each is a continuation-in-part of Ser. No. 131,763, April 6, 1971, abandoned.

[51] Int. Cl.[2] ..... A62D 1/00

[52] U.S. Cl. ..... 252/3; 252/8.05; 260/534 R

[58] Field of Search ..... 252/3, 8.05

[56] References Cited

U.S. PATENT DOCUMENTS

| | | | |
|---|---|---|---|
| 3,475,333 | 10/1969 | Meldrum et al. | 252/3 |
| 3,562,156 | 2/1971 | Francen | 252/8.05 |
| 3,655,555 | 4/1972 | Rossmy et al. | 252/3 |
| 3,772,195 | 11/1973 | Francen | 252/3 |
| 3,849,315 | 11/1974 | Chiesa | 252/3 |

*Primary Examiner*—Leland A. Sebastian
*Attorney, Agent, or Firm*—Connolly and Hutz

[57] ABSTRACT

Aqueous foam type film-forming fire-fighting composition contains surfactant having fluorocarbon radical and of relatively simple and effective structure but not suitable by itself for use with sea water, combined with a foamability-improving surfactant that is suitable for use with sea water and in an amount that makes the entire composition suitable for use with sea water.

6 Claims, No Drawings

FIRE FIGHTING COMPOSITIONS

This application is a continuation-in-part of patent applications Ser. No. 254,404 filed May 18, 1972 U.S. Pat. No. 3,849,315 granted Nov. 19, 1974; Ser. No. 307,479 filed Nov. 17, 1972, now abandoned; Ser. No. 369,584 filed June 13, 1973U.S. Pat. No. 3,957,657 granted May 18, 1976; and Ser. No. 434,544 filed Jan. 18, 1974, (subsequently abandoned.) Each of the first three applications is in turn a continuation-in-part of Ser. No. 131,763 filed Apr. 6, 1971 but subsequently abandoned.

The present invention relates to aqueous foam-forming fire-fighting compositions that contain a surfactant having a fluorocarbon radical, and so sharply reduce the surface tension of water as to cause an aqueous film to form over hydrocarbons on which the foamed compositions are applied. Such compositions are disclosed in the above-listed parent applications as well as in U.S. Pat Nos. 3,562,156, 3,772,195 and 3,258,423.

Among the objects of the present invention is the provision of novel fire-fighting compositions for the above purposes. Additional objects of the present invention include the provision of fire-fighting materials that are of outstanding effectiveness and simple to manufacture.

The foregoing as well as further objects of the present invention will be more clearly understood from the following description of several of its exemplifications.

According to the present invention the foregoing aqueous foam type fire-fighting compositions are improved by selecting as the surfactant with the fluorocarbon radical, one that is not suited by itself for use with sea water even though practical compositions of this type and containing such surfactant are to be suitable for use with sea water.

The general requirements for a fluorinated surfactant in such use has heretofore been that it reduces the surface tension of water at foam-forming concentration to less than 19 dynes per centimeter, that it be soluble in water at concentrations used for storing the foam-forming mixtures, and that it be compatible with sea water so that sea water can be used to dilute the stored mixtures to foam-forming condition.

For best results with burning hydrocarbons, such as isooctane (2,2,4-trimethylpentane), which are extremely difficult to film over, the surface tension of the water in the foam should be less than 17 dynes per centimeter. Certain synergistic surfactants such as the silicone surfactants of the above-listed patent applications are combined with the surfactants that have a fluorocarbon radical to reduce the surface tension of water even more than is possible by the fluorocarbon radical-containing surfactant alone regardless of its concentration. Such synergistic action is extremely helpful in that it reduces the concentration of fluorocarbon-radical-containing surfactant needed, thus reducing the cost of the compositions and also the ecological effect of the surfactants having the fluorocarbon radical and their fluorocarbon moiety, both of which are in general toxic and the fluorocarbon moiety of which is extremely "hard" ecologically. These moieties are difficult to degrade biologically even in sunlight and in dilute aqueous solution in contact with excess oxygen. However the synergistic action only reduces the surface tension a relatively small amount below that provided by the fluorocarbon-radical-containing surfactant alone. It has accordingly been advisable to select a fluorocarbon-radical-containing surfactant that by itself reduces the surface tension as much as possible, and to then compound it for best results.

The foregoing search for maximum surface-tension lowering has been complicated by the practical need to provide fire-fighting compositions that can be foamed effectively with sea water as well as fresh water, and that are compatible with film-forming compositions marketed by others.

For use on board ships or in tank farms at seaports, sea water is the most readily accessible source of the water needed to dilute the fire-fighting compositions so they can be properly foamed. While it is possible to use fresh water with compositions that will only foam with fresh water, as for example where plenty of fresh water is available at all times, the commercialization of fire-fighting compositions that are restricted to fresh water use has been unsatisfactory and the industry has come to insist on compositions that can be foamed with either fresh or sea water.

Similarly, different manufacturers of these film-forming compositions may use different surfactants and for most desirable use it is important that the surfactants of each such manufacturer be compatible with those of all other such manufacturers so that their compositions can be used interchangeably and can be mixed with each other when needed.

Certain fluorocarbon-radical-containing surfactants will precipitate or be rendered less effective for foaming when mixed with sea water, and the industry has generally excluded such surfactants from fire-fighting film-forming compositions because of this characteristic. Unfortunately blanket exclusions of this type so restrict the choice that desirable surfactants are lost to the industry.

On the other hand for compatibility with other film-forming compositions that use different kinds of surfactants, the use of fluorocarbon-radical-containing surfactants that have an amino carboxylic hydrophile moiety is particularly desirable.

A feature of the present invention is the selection of easily prepared fluorocarbon-radical-containing surfactants that provide strong surface tension lowerings and have good compatibility, but that by themselves are not suitable for use with sea water. Such a fluorocarbon-radical-containing surfactant is then compounded into a formulation that provides a concentrate contributing the best filming results, by combining such a fluorocarbon-radical-containing surfactant with one or more foamability-improving surfactants that make the combination foamable to the degree needed for fire-fighting, and yet suitble for dilution with sea water. This is particularly significant for compositions that contain a silicone surfactant inasmuch as silicone surfactants as a class behave poorly in sea water.

Thus it has been discovered that fluorocarbon-radical-containing surfactants having a stable essentially linear aminocarboxylic acid structure with not more than two branches each in the form of a substituent no larger than methyl, give excellent surface tension lowerings even though by themselves they are not very active in sea water. Examples of such surfactants are:

$$R_f-CH=CH-CH_2-O-CH_2-\overset{\overset{\displaystyle OH}{|}}{CH}-CH_2-\overset{\overset{\displaystyle CH_3}{|}}{N}-CH_2-COOH\,,$$

-continued

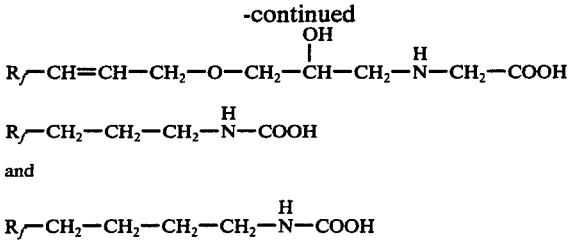

$R_f$being perfluorinated linear unbranched alkyl of from 6 to 10 carbons. The chain length of the entire compound is preferably such that the bridge between the $R_f$ and the O—$CH_2$—CHOH at which the hydrophile portion effectively commences in the first two compounds, or between the $R_f$and the N of the next two, is from about 3 to about 6 atoms long. The COOH group in these compounds is not considered in counting the branches. In this connection the $SO_3H$ group is generally inferior to the COOH group in its effectiveness for the present invention.

The above-listed fluorocarbon-radical-containing surfactants have a simple structure and are easy to prepare as well as relatively inexpensive. In addition they provide surface tensions as low as 17 or less dynes per centimeter in 0.1% concentrations in water. Moreover compounding any of these surfactants with at least two times its weight of a foamability-improving surfactant compatible with sea water, permits the compounded mixture to be effectively diluted with sea water and still rapidly form a good film over burning hydrocarbons. The further addition of a silicone surfactant, as in the formulations of the above-listed parent applications, provides a synergistic action that reduces the surface tension even further. Here again though, the foamability-improving surfactant compatible with sea water should be in an amount at least two times the combined weight of the fluorocarbon-radical-containing and silicone surfactants.

The following is an example of the preparation of one of the above-listed improved fluorinated surfactants:

EXAMPLE I

A mixture of essentially $C_6$, $C_8$and $C_{10}$alpha-iodo-perfluoroalkyls obtained as described on page 3766 of the Haszeldine article in Journal of the Chemical Society (London), 1953, pp. 3761–68, is mixed with an equimolecular amount of allyl glycidal ether, and to the mixture is added a catalytic amount of alpha,alpha'-azo(bis-isobutyronitrile). The combined mixture is heated on a steam bath for four hours producing the addition product resulting from the saturation of the allyl double bond by the iodo compound. The product is then brought to a temperature of 80°C in the presence of excess NaOH to split off hydrogen iodide and regenerate the double bond, leaving an intermediate having the following formula:

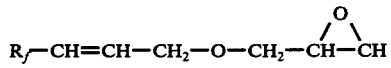

This intermediate is now mixed with an equimolecular amount of N-methylglycine which reacts with the excess NaOH to form its sodium salt, and this mixture heated on a steam bath for 6 hours, giving the desired flourocarbon-radical-containing surfactant in a crude form that needs no purification for use. The crude surfactant lowers the surface tension of water to 17 dynes per centimeter at 0.1% concentration. This is an exceedingly low surface tension and seems to be associated with the linearity of the surfactant's structure plus its low degree of branching. The linearity also appears improved by the presence of the double bond which has a linearizing steric effect and is also relatively inert chemically. The crude material can be purified by absorption in a silica gel column and elution with isopropyl alcohol.

The other fluorocarbon-radical-containing surfactants listed above can be made in a similar manner, the last two by condensing the iodide with allyl chloride, reacting the resulting chloride with the ethyl ester of glycine or sarcosine, hydrogenerating the double bond, and hydrolyzing off the esterifying ethanol. Hydrogenation can also be used to saturate the double bond of the first two surfactants in the foregoing list, and it can be omitted so as to leave a double bond in the last two surfactants, to produce useful products.

A very effective fire-fighting composition according to the present invention has the following formulation:

EXAMPLE II

| | |
|---|---|
| Tris-(hydroxymethylamino)methane | 24 g. |
| The crude fluorinated surfactant of Example I (50% aqueous solution) | 110 g. |
| The surfactant 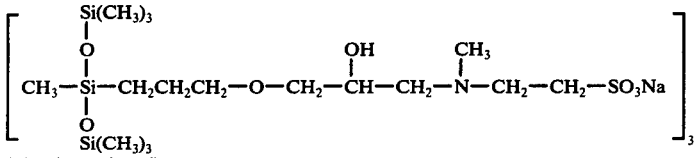 (50% in methanol) | 110 g. |
| Oleyl alcohol ethoxylate having 20 to 25 ethoxy groups per mol | 28 g. |
| Salt-free grade of 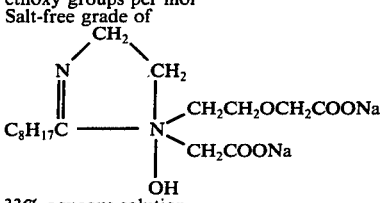 33% aqueous solution | 150 mls. |
| Corresponding imidazoline in which the $C_8H_{17}$ is replaced by $C_{10}H_{21}$ | 150 mls. |

EXAMPLE II-continued

| | |
|---|---|
| Corresponding imidazoline in which the $C_8H_{17}$ is replaced by cocoanut oil alkyl | |
| 38% aqueous solution | 100 mls. |
| Ethylene glycol | 200 mls. |
| Butyl carbitol | 400 mls. |
| Decyl dimethylamineoxide 30% aqueous solution | 250 mls. |
| Water to bring total weight to | 3890 g. |

This formulation when diluted with 16 ⅔ parts by volume of water and foamed to an expansion of 8 in fresh water, or 6.5 in sea water, makes an exceedingly effective fire-extinguishing material. It foams exceptionally well in sea water and maintains the film-forming ability of the fluorinated surfactant of Example I in sea water, even when as shown in Ser. No. 254,404 the preferred imidazoline foamers having a $C_{10}$ or lower alkyl group constitute only about 40% of the total foamer used to provide fire-fighting foamability.

As noted in the above-listed parent applications, the fluorinated surfactants as well as the silicone surfactants are relatively expensive chemicals and so the foamability is imparted essentially entirely by a surfactant that is neither a fluorocarbon-radical-containing nor a silicone surfactant. Other preferred foamability improving surfactants according to the present invention include those disclosed in application Ser. No. 254,404 as well as the sulfobetaines disclosed in Ser. No. 369,584, and

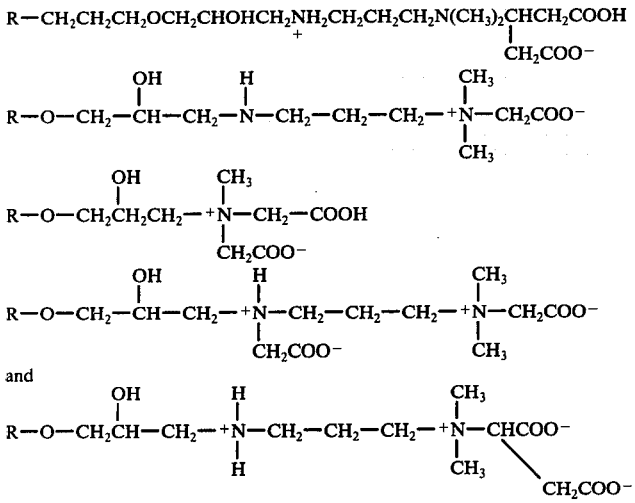

in each case R being a linear branched or unbranched alkyl of from 6 to 10 carbons.

The last five foamers are made by reacting the corresponding alkyl glycidal ethers, the amines with:

N,N-dimethyl amino propylamine or N-methylglycine, in a 50/50 mixture of isopropyl alcohol and water heated at reflux for four hours, followed by the addition of chloroacetic acid or maleic acid with heating for an additional 3 hours.

EXAMPLE III

The formulation of Example II is modified by replacing all the imidazole surfactants and the amine oxide surfactant with 173 mls. of 50% aqueous solution of

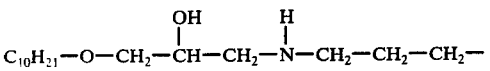

-continued

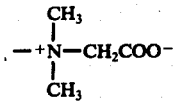

and replacing the silicone surfactant with an equal quantity of

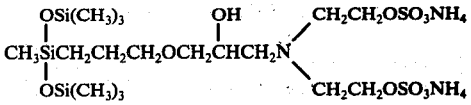

The resulting concentrate diluted with 16 ⅔ parts of water by volume, and foamed to an expansion of 3 in fresh water, 2 in sea water, is a very good fire-extinguisher, particularly for use in strong winds.

EXAMPLE IV

The formulation of Example II is modified by replacing its first and second imidazoline surfactants with 300 mls. of the same foamer solution substituted in Example III. The resulting formulation diluted with 16 ⅔ times its volume of fresh water gives very good fire-extinguishing when foamed to an expansion of 6.5, or 5.5 if sea water is substituted for the fresh water.

Similar good results are obtained when the fluorocarbon-radical-containing surfactants of the foregoing examples are replaced by any of the other above-identified fluorocarbon-radical-containing surfactants having a stable essentially linear aminocarboxylic acid structure with not more than two branches each in the form of a substituent no larger tha methyl. Also the silicone surfactant can be replaced with any of the others disclosed in the prior applications without significantly detracting from the results. Thus $[(CH_3)_3SiO]_2\ Si(CH_3)\ C_3H_6(OC_2H_4)_3OC_3H_6SO_3Na$ makes a good substitute for the silicone surfactant in the present examples.

Hydrophilic resins can be added to the formulations of the present invention in the manner disclosed in the prior applications, and are helpful. The tris(hydroxymethylamino) methane can be omitted where no pH buffering is needed, or can be replaced with a different buffer. The ethylene glycol and butyl carbitol can also be omitted if there is no danger of freezing. As pointed out in Ser. No. 369,584 foaming agent that has a chain of at least 15, preferably at least 20, ethylene oxide units along with an alkyl of at least 14 carbons, is particularly helpful in these fire-fighting combinations.

The improved fluorocarbon-radical-containing surfactants of the present invention contribute their better surface-tension-lowering to formulations that contain synergistic silicone surfactants as well as to formulations not containing silicone surfactants and in which nothing lowers the surface tension below the value reached by the fluorocarbon-radical-containing surfactant alone. Such formulations containing no silicone surfactant have their fluorocarbon-radical-containing surfactant in larger concentrations than shown above in order to bring the surface tension down to the desired values. When used with silicone surfactants the preferred silicone surfactants are those of Examples II and III, supra.

It will be noted that the formulations of the present invention can contain anti-freeze ingredients, hydrophilic resins, pH buffers, preservatives, and other ingredients that make the formulations more stable, more storageable and/or more compatible with other types of such formulations. The formulations of the present invention can also be used in the gel-forming types of foam-forming fire-fighting compositions suitable for use on polar solvents, as disclosed for instance in Ser. No. 307,479, now abandoned. In any of the foregoing formulations there may be mixtures of fluorocarbon-radical-containing surfactants and/or mixtures of silicone surfactants. The fluorinated surfactant of Example II may be made from a pure alpha-iodo perfluoroalkane so that it does not have a mixture of $C_6$, $C_8$ and $C_{10}$ perfluoroalkane groups. Conversely the silicone surfactant of Example I may be made so that it contains its bracketed moiety two, four or even one time, rather than three times as shown, and these various modified forms can be mixed together.

Obviously many modifications and variations of the present invention are possible in the light of the above teachings. It is, therefore, to be understood that within the scope of the appended claims the invention may be practiced otherwise than as specifically described.

What is claimed is:

1. In an aqueous foam type fire-fighting composition containing a surfactant with a fluorocarbon radical, which surfactant helps form an aqueous film over the surface of a burning hydrocarbon onto which the composition is applied, the improvement according to which (a) said surfactant is by itself unsuited for use with sea water, its hydrophile moiety is an aminocarboxylic acid structure linked to a perfluoroalkyl by a chain of 3 to 6 atoms, and it has a stable essentially linear structure which with the exception of the carboxyl contains not more than two branches each in the form of a substituent no larger than methyl, and (b) the composition is rendered suitable for foaming in sea water by at least one foamability-improving surfactant suitable for such use, at least 40% of the foamability-improving surfactant having a lyophilic hydrocarbyl group with from 6 to 10 carbons.

2. The combination of claim 1 in which the first-mentioned surfactant alone lowers the surface tension of water to not over 17 dynes per centimeter at a concentration of 0.1%.

3. In an aqueous foam type fire-fighting composition containing a silicone surfactant and a surfactant with a fluorocarbon radical, which surfactants together help form an aqueous film over the surface of a burning hydrocarbon onto which the composition is applied, the improvement according to which (a) the surfactant with the fluorocarbon radical is by itself unsuited for use with sea water, its hydrophile moiety is an aminocarboxylic acid structure linked to a perfluoroalkyl by a chain of 3 to 6 atoms, and has a stable essentially linear structure which with the exception of the carboxyl contains not more than two branches each in the form of a substituent no larger than methyl, and (b) the composition is rendered suitable for foaming in sea water by at least one surfactant suitable for such use, at least 40% of the foamability--improving surfactant having a lyophilic hydrocarbyl group with from 6 to 10 carbons.

4. The combination of claim 3 in which the surfactant with the fluorocarbon radical is

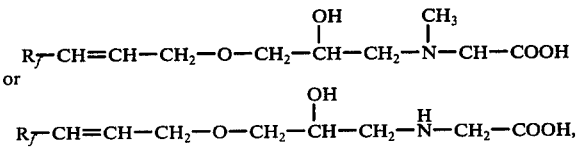

or $R_f$ being a perfluorinated linear unbranched alkyl of from 6 to 10 carbons.

5. The combination of claim 1 in which the foamability-improving surfactant is selected from the class consisting of

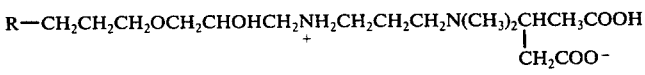

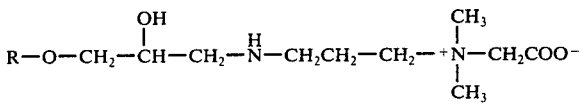

-continued

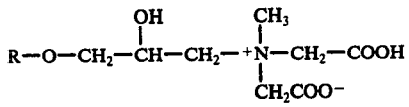

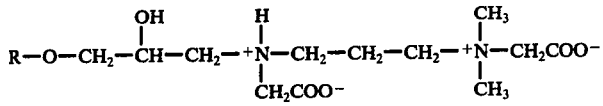

and

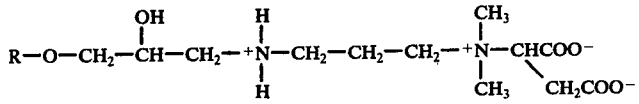

where R is an alkyl of from 6 to 10 carbons.

6. In an aqueous film-forming fire-fighting foamable liquid containing a dissolved silicone surfactant and a dissolved surfactant having a fluorocarbon radical, said surfactants being contained in amounts that give the liquid a surface tension at least as low as 17 dynes per centimeter but do not give it good foamability, and also containing one or more foamability-increasing surfactants that have neither the fluorocarbon nor silicone structure, to bring the foamability of the liquid up to the level needed for a fire-fighting foam, the improvement according to which at least 40% of the foamability-increasing surfactants is selected from the class consisting of

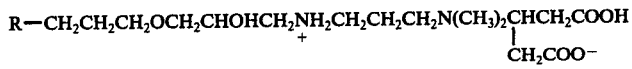

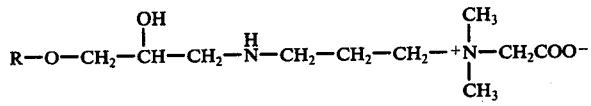

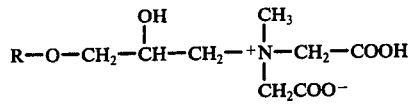

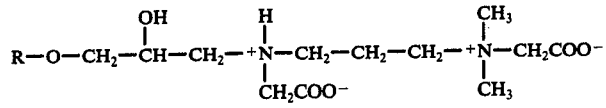

and

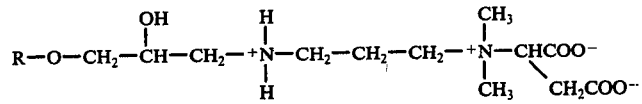

where R is alkyl of from 6 to 10 carbons.

* * * * *